United States Patent [19]

Fresnel

[11] Patent Number: 5,031,298

[45] Date of Patent: Jul. 16, 1991

[54] METHOD OF CONTROLLING CONSTANT TEMPERATURE INSIDE A SHRINK-FITTING TUNNEL

[75] Inventor: Jacques Fresnel, Paris, France

[73] Assignee: Sleever International Company, Morangis, France

[21] Appl. No.: 396,524

[22] Filed: Aug. 21, 1989

[30] Foreign Application Priority Data

May 11, 1989 [FR] France ..... 89 06183

[51] Int. Cl.[5] ..... B23P 11/02; C03B 27/00

[52] U.S. Cl. ..... 29/447; 29/DIG. 35; 65/162

[58] Field of Search ..... 29/235, 423, 447, 448, 29/728, 801, DIG. 35, 405; 65/162, 163; 148/774; 432/11, 239; 53/373, 442

[56] References Cited

U.S. PATENT DOCUMENTS

| | | | |
|---|---|---|---|
| 4,601,743 | 7/1986 | Canfield | 65/163 X |
| 4,767,434 | 8/1988 | Schwartz et al. | 65/163 X |
| 4,870,802 | 10/1989 | Cerf | 53/373 X |

FOREIGN PATENT DOCUMENTS

| | | |
|---|---|---|
| 0058602 | 2/1982 | European Pat. Off. . |
| 0128056 | 4/1984 | European Pat. Off. . |
| 2024239 | 12/1971 | Fed. Rep. of Germany . |
| 2852967 | 6/1980 | Fed. Rep. of Germany . |
| 7530896 | 10/1975 | France . |
| 8515717 | 10/1975 | France . |
| 2565553 | 6/1984 | France . |

*Primary Examiner*—Timothy V. Eley
*Assistant Examiner*—Peter Dungba Vo
*Attorney, Agent, or Firm*—Mason, Kolehmainen, Rathburn & Wyss

[57] ABSTRACT

A method of controlling the temperature in a tunnel open at both ends and along which objects are displaced by conveyor means, the tunnel including heating or cooling means disposed along its two side walls between which the conveyed objects pass. According to the invention, the temperature is sensed in a particular zone of the tunnel in which a predetermined temperature is desired, and in organizing transverse displacement of the heating or cooling means (104) is organized in a direction essentially perpendicular to the direction in which the objects (103) are conveyed by means of a servo-control system causing the heating or cooling means to be displaced automatically mutually towards each other or away from each other whenever the sensed temperature differs from the predetermined temperature, thereby having the effect of permanently ensuring a constant temperature environment for the objects concerned in the above-mentioned zone of the tunnel. The invention is particularly suitable for shrinking heat-shrink sleeves onto flasks for decorative and/or protective purposes, and it is also suitable for cooling down glass receptacles.

11 Claims, 2 Drawing Sheets

METHOD OF CONTROLLING CONSTANT TEMPERATURE INSIDE A SHRINK-FITTING TUNNEL

The present invention relates to heat treatment applied to objects passing along a tunnel which is open at both ends, and more particularly to controlling the temperature in such tunnels.

BACKGROUND OF THE INVENTION

Such tunnels generally include means for conveying objects, heating or cooling means disposed along the side walls of the tunnel, and means for blowing a gaseous fluid into the tunnel at a predetermined temperature and along a direction which is essentially perpendicular to the direction along which the objects are conveyed.

The gaseous fluid, e.g. air, may be blown in to such a tunnel either for cooling or else for heating the objects being conveyed, and thus although the present invention is described essentially with reference to examples in which objects are heated, it should be understood that the invention is equally applicable to cooling.

Numerous applications may be concerned, and with respect to cooling, mention may be made of bottles of glass which need to be cooled in controlled manner after annealing, mainly for the purpose of releasing stress, and with respect to heating, mention may be made of shrinking a heat-shrink sleeve or length of sheath onto an object, in which case the sleeve is threaded loosely over the object to be decorated and/or protected, and is then heated to a temperature higher than the softening temperature of the film from which it is made so as to cause it to shrink onto the said object.

The invention relates more particularly to heating and shrinking on heat-shrink sleeves, however it must be understood that this is merely a particular application of the method of controlling temperature in accordance with the present invention and that the invention is not limited to this particular application.

It is now common practice to use certain types of plastic film optionally to print on them, and then form them into tubes by bringing together two edges of a strip and bonding them to each other, said tube then serving to decorate and/or protect an object, or more particularly the packaging a product.

Thus, receptacles such as bottles, aerosols, flasks, food cans, and other packaging objects are being provided more and more frequently with a protective sleeve or sheath, or a tamper-proofing ring, made of heat-shrink plastic material. The sleeve is placed around the receptacle, and after external heating to a temperature higher than its softening temperature, it should fit closely around the outline of the receptacle with a minimum of deformation. Such heat-shrink sleeves are made from plastic films (generally polyvinyl chloride films) to which memory is imparted during manufacture, and such films are generally referred to as heat-shrink films. These films are generally stretched essentially in the circumferential direction of the objects to be coated so as to acquire a memory (or shrink percentage) of up to 70% in the stretch direction (with the films commonly in use having a memory lying in the range 50% to 60%). Memory in the longitudinal direction, i.e. corresponding to the height of the length of sheath is only about 3% to 7%.

In order to impart memory to a film of plastic material (of polyvinyl chloride, polystyrene, or polyester, for example), the film must be heated to a very accurate temperature which is generally selected to be less than the vitreous transition point of the plastic material separating its amorphous zone and its elastic zone, while simultaneously subjecting the material to transverse and/or longitudinal traction. Heating softens the film, thereby allowing its molecules to creep and thus enabling the initial dimensions of the film to be increased, with a corresponding reduction in the initial thickness of the film.

Such films which are generally printed on and/or decorated to serve as labels on coated objects are said to be "mono-oriented" or "mainly mono-oriented". If transparent polyvinyl chloride films are used, printing may be performed on the inside surface, thereby providing a shiny external appearance and simultaneously protecting the printing against any risk of being rubbed off. In addition to the decorative aspect, this may be useful not only for tamper-proofing the contents, but also for setting up a barrier, e.g. for reducing loss of perfume from polyproylene packaging, or a loss of carbon dioxide gas from carbonated drinks in packaging made of polypropylene terephthalate.

Such an application has become widespread in the sale of consumer goods since it offers a wide range of decorating options, including the possibility of reproducing photographs, and it can be used for objects having a very wide variety of shapes.

Although the techniques of manufacturing heat-shrink films, of printing on them, of forming them into tubes, and of placing sleeves around objects or packages have already been substantially mastered, the same is not true of the operation of shrinking said sleeves, and shrinking becomes particularly difficult when the object or package has an irregular section which is triangular, square, or rectangular in shape, including faces having convex and/or concave zones.

It is essential for shrinking to take place uniformly around the object or package, i.e. without folding, wrinkling, or puncturing the sheath, and without deforming the printing provided on the film, particularly since the printing need not only be decorative, but may also have a direct effect on utilization (reading bar codes, printing legally-required messages, or instructions for use, for example).

The difficulties encountered in mastering the shrinking operation are largely due to problems which are essentially thermal, since the temperature to which the film is heated must be simultaneously accurate, constant, and uniform over the entire area of the film, while also being as low as possible.

Firstly, the temperature must be accurate.

There are only a few degrees between the elastic zone and the amorphous zone, and each plastic film has its own particular softening point and separation temperature between its elastic zone and its amorphous zone depending on the nature of the film and its formulation. In order to shrink the film, it is essential to know the temperature which corresponds to the beginning of the amorphous zone since the film restores its memory so long as its temperature remains below the temperature marking the beginning of the amorphous zone, with at least some of its memory acquired in the elastic zone being lost should this temperature be exceeded.

For example, with a film for which the amorphous zone begins at 110° C. and having a memory which gives it a capacity to shrink by 50%, the full 50% shrinkage cannot be obtained if the temperature of 110°

C. is exceeded. Under such circumstances, it would no longer be possible to shape such a film in satisfactory manner on an object whose cross-sectional shape requires 50% shrinkage in the film. Numerous types of object would thus be barred from being coated by means of a heat-shrink sleeve.

The temperature must be constant.

The person skilled in the art is aware of shrinkage curves for films as a function of temperature (see FIG. 5, and corresponding longitudinal shrinkage curve RL and transverse shrinkage curve RT). From these curves, it can be deduced that if the film is subjected to a temperature of 80° C. at some given instant (point A), then a shrinkage percentage of about 32% can be obtained in the transverse direction, but if at some other instant the temperature of the film is no more than 75° C. (point B), then the portion of the film which has been subjected to this lower temperature will shrink by only 20% in the transverse direction. Such a large difference in shrinkage percentage (or in shrinkage rate) for so small a temperature difference clearly demonstrates that it is essential for the temperature to be constant.

The temperature must be uniform over the entire area of the film.

Referring to the same shrinkage curves, and assuming that the object has a simple right cross-section, imagine that two different points (A and B, FIG. 5) on the film are respectively at 80° C. and at 75° C., then the shrinkage will not be uniform between those two points on the film, thereby distorting or deforming the printing on the film.

It should also be observed that in spite of having a temperature which is both constant and uniform, there can also be heat loss from the film making contact at some points with the object to be coated while not making contact at other points, for example when the object has a concave face. By making contact with the object, heat is transferred from the film to the object, thereby reducing film temperature and giving rise to the consequences mentioned above.

Finally, the temperature should be as low as possible.

For a film having a high degree of mono-orientation, it may be possible to obtain 50% transverse shrinkage for only 7% to 8% longitudinal shrinkage. However, if the temperature to which the film is heated significantly exceeds the temperature which allows 50% transverse shrinkage to occur, not only is it no longer possible to obtain the 50% in full, but also the shrinkage percentage in the longitudinal direction is increased. The ratio of longitudinal shrinkage to transverse shrinkage therefore increases and can reach a value which gives rise to uncontrolled deformation of the printing to such an extent that the position of the printing on the object becomes entirely random since the printing moves arbitrarily both horizontally and vertically. Under such conditions, it is not possible to magnify the image adequately in both directions prior to printing to compensate for shrinkage of the film.

The above considerations show that it is essential to be able to control the temperature in the tunnel used for heating purposes with a very high degree of accuracy.

Several means have been recommended in order to attempt to solve some of the difficulties outlined above. For example: the use of tunnels having multiple preheat-shrink zones with flexible air-blowing tubes (European patent number 0 058 602); or the use of inwardly directed folds around the perimeter of the sleeve to be shrunk and in contact with the surface of the object to be coated. Reference may also be made to French patent number 75 30 896.

More recently, the Applicant has proposed blowing a gaseous fluid between the object and the loose sleeve to be shrunk, thereby inflating the sleeve and holding it out of contact with the object to be coated, with the temperature of the gaseous fluid being chosen to be below the softening temperature of the film constituting the sleeve, thereby making it possible to bring the temperatures of the inside and outside faces of the sleeve progressively into equilibrium and to control the thermal gradient within the film so as to obtain contact between the film and the object at a desired instant (see French patent number 85 15 717, on this topic).

This solution is advantageous, but it does not solve the problem of controlling temperature in the tunnel in the zone occupied by the means for blowing in the gaseous fluid.

However, control of this temperature is crucial in order to shrink the sleeve effectively while raising its inside and outside faces simultaneously to a common predetermined temperature, and in particular the temperature marking the separation between the elastic zone and the amorphous zone of the film.

It is very difficult to obtain such control in the tunnels used by virtue of numerous external disturbances which continually alter the ambient temperature in the zone occupied by the blower means.

It is easy to blow in a gaseous fluid at a constant predetermined temperature, but it is practically impossible to stabilize the temperature in a given zone of the tunnel, in particular at the temperature selected for shrinking the sleeve.

The person skilled in the art must always counter external disturbances of diverse origins. The inside of the tunnel is subjected along its length to convection currents which keep moving its temperature zones (currents due in particular to the temperature and the number of objects passing along the tunnel and/or to air being sucked into the tunnel). The thermal inertia of the shrinkage system and of the object conveyor system should also be mentioned.

Finally, persons skilled in this art are aware of a real need for a technique enabling temperature to be controlled satisfactorily.

An object of the invention is to provide a method, and an apparatus for implementing the method, for accurately controlling the temperature in a tunnel which is open at both ends, for the purpose of solving the above-mentioned difficulties.

Another object of the invention is to provide a method and an apparatus which are both simple and reliable, and which in particular make it possible to obtain uniform shrinking of a heat-shrink sleeve without deforming the printing thereon and without forming folds, wrinkles, or punctures therein, regardless of the shape or size of the object to be decorated and/or protected.

A subsidiary object of the invention in the context of this particular application is to enable said controlled shrinking to take place at relatively low temperatures on the surface of the film, e.g. 100° C., thereby avoiding many of the above-mentioned drawbacks of random shrinkage when performed at conventional temperatures lying in the range of 180° C. to 250° C., and also reducing energy consumption and the length of tunnel required for performing shrinking.

SUMMARY OF THE INVENTION

The present invention provides a method of controlling the temperature in a tunnel open at both ends and along which objects are displaced by conveyor means, said tunnel including heating or cooling means disposed along its two side walls between which the conveyed objects pass, wherein the method consists in sensing the temperature in a particular zone in which a predetermined temperature is desired, and in organizing transverse displacement of the heating or cooling means in a direction essentially perpendicular to the direction in which the objects are conveyed by means of a servo-control system causing said heating or cooling means to be displaced automatically mutually towards each other or away from each other whenever the sensed temperature differs from said predetermined temperature, thereby having the effect of permanently ensuring a constant temperature environment for the objects concerned in said zone of the tunnel.

Preferably, the transverse displacement of the heating or cooling means is organized symmetrically about the midplane of the tunnel on either side of which the side walls of the tunnel are disposed; in particular, the transverse displacement of the heating or cooling means is obtained by moving two side boxes having said means disposed on their inside faces. More particularly, it is advantageous to organize these transverse displacements in such a manner that the value of the displacement varies linearly as a function of the difference detected between the temperature as sensed and the predetermined temperature.

Also advantageously, the temperature is sensed in said particular zone of the tunnel in the vicinity of the passing objects and as far away as possible from the heating or cooling means; in particular, the temperature is sensed by means of a fixed temperature sensor which is protected from the direct action of the heating or cooling means.

In a particular application of the method, applied to shrinking a heat-shrink sleeve or length of sheath onto an object, and in which the sleeve is placed loosely over the object and is heated in order to be shrunk onto said object, said predetermined temperature is selected to cause the sleeve to shrink uniformly when the object inside the sleeve enters the said particular zone of the tunnel where a constant temperature environment is ensured by the servo-controlled transverse displacement of the heating means.

It is then preferable that the objects as they pass along the tunnel are also subjected to a flow of a gaseous fluid in a direction substantially perpendicular to the direction in which said objects are conveyed, said air flow serving to prior inflate each sleeve as the corresponding object penetrates into the particular zone of the tunnel, with the fluid being blown in at said predetermined temperature in the said particular zone; in particular, the gaseous fluid is blown in by directing the flow of gaseous fluid down onto the objects with the general flow direction being substantially vertical.

It is also advantageous, prior to reaching the zone of the tunnel concerned by blowing in the gaseous fluid, for the object inside its sleeve to be subjected to preheating solely by the action of the heating means of said tunnel, in order to reach a temperature very close to the shrinking point of the sleeve.

Also preferably, downstream from the zone of the tunnel into which the gaseous fluid is blown, the object onto which the sleeve has been shrunk is subjected to heating by the action of the heating means of the tunnel and also by the action of an additional blower means in order to be raised for a very short period of time to a high temperature, considerably greater than the predetermined temperature of the gaseous fluid, this corresponding to a finishing or smoothing operation.

The invention also provides an apparatus for implementing the above method, and intended to be fitted to a tunnel including means for conveying objects and heating or cooling means disposed along its two side walls between which the conveyed objects pass, the apparatus comprising a temperature sensing member disposed in a particular zone of the tunnel in which a predetermined temperature is desired, at least one carriage supporting the heating or cooling means, said carriage being moveable transversely in a direction essentially perpendicular to the direction in which the objects are conveyed, and motorized drive means for automatically displacing said carriage when the temperature sensed by said member differs from said predetermined temperature for the purpose of moving said heating or cooling means towards each other or away from each other.

Preferably, the moving carriage carries a side box on whose inside face the heating or cooling means are mounted, with the servo-controlled transverse displacement being applied to said side box of the tunnel.

In a particularly advantageous embodiment, the apparatus includes two carriages supporting the heating or cooling means associated with each of the side walls of the tunnel, with transverse displacement of said carriages being organized symmetrically about the midplane of the tunnel on either side of which the side walls of said tunnel are disposed. It is then advantageous for the two moving carriages to be displaced on associated transverse rails provided in the bottom of the tunnel beneath the means for conveying the objects, said moving carriages being also connected to the motorized drive means by a common coupling means.

It is then preferable, for the motorized drive means to be essentially constituted by a motor and stepdown gear box unit, with the coupling means being preferably provided in the form of a continuous transverse chain driven by said unit with each length of the chain bearing a moving carriage.

In this case, it is advantageous for the said unit to comprise an electric motor controlled from the temperature sensing member via an associated temperature regulator, and a stepdown gear box having an outlet toothed wheel meshing with a continuous transverse chain fixed to the carriages; in particular, the connections between the motor and gear box unit and both the toothed wheel and the temperature regulator of the temperature sensor member are such that the displacement of each of the carriages varies linearly as a function of the temperature difference sensed by the temperature sensor member, e.g. one millimeter per degrees Celsius.

It is also advantageous for the temperature sensor member to be a fixed temperature sensor connected to a temperature regulator, said temperature sensor including means for protecting it from the direct action of the heating or cooling means.

Preferably, the temperature sensor is received in an open protective tube in which suction is established, and the open bottom end of the protective tube is chamfered, and directed towards the conveyed objects; in particular, the protective tube is a quartz tube connected to a suction venturi.

In a particular application in which a heat-shrink sleeve or length of sheath is to be shrunk onto an object by heating the sleeve as threaded loosely onto the object in order to cause the sleeve to shrink onto the object, it is advantageous for the apparatus to comprise heating means disposed along the two side walls of the tunnel and essentially constituted by heater elements, e.g. infrared radiators.

It is then preferable for the apparatus also to include means for blowing a gaseous fluid towards the conveyed objects along a direction which is substantially perpendicular to the conveying direction, with the blowing taking place in said particular zone of the tunnel at said predetermined temperature and associated with the servo-controlled transverse displacement of the heater elements.

In this case, it is advantageous for the blower means to include a wind box having a bottom elongate slot for producing a continuous sheet of air, said wind box being disposed above the tunnel so as to direct the flow of gaseous fluid down onto the objects with the general flow direction being substantially vertical. More precisely, the wind box includes a succession of slides enabling different longitudinal zones of the tunnel to have different air flow rates, and the wind box is supported by a bracket with means for adjusting the height and/or the longitudinal position of said wind box.

Finally, it is advantageous for the apparatus to include, downstream from the wind box, an additional blower member, e.g. of the extractor fan type, for providing optional final extra heating of the objects.

BRIEF DESCRIPTION OF THE DRAWINGS

An embodiment of the invention is described by way of example with reference to the accompanying drawings, in which.

DETAILED DESCRIPTION

Figure 2:
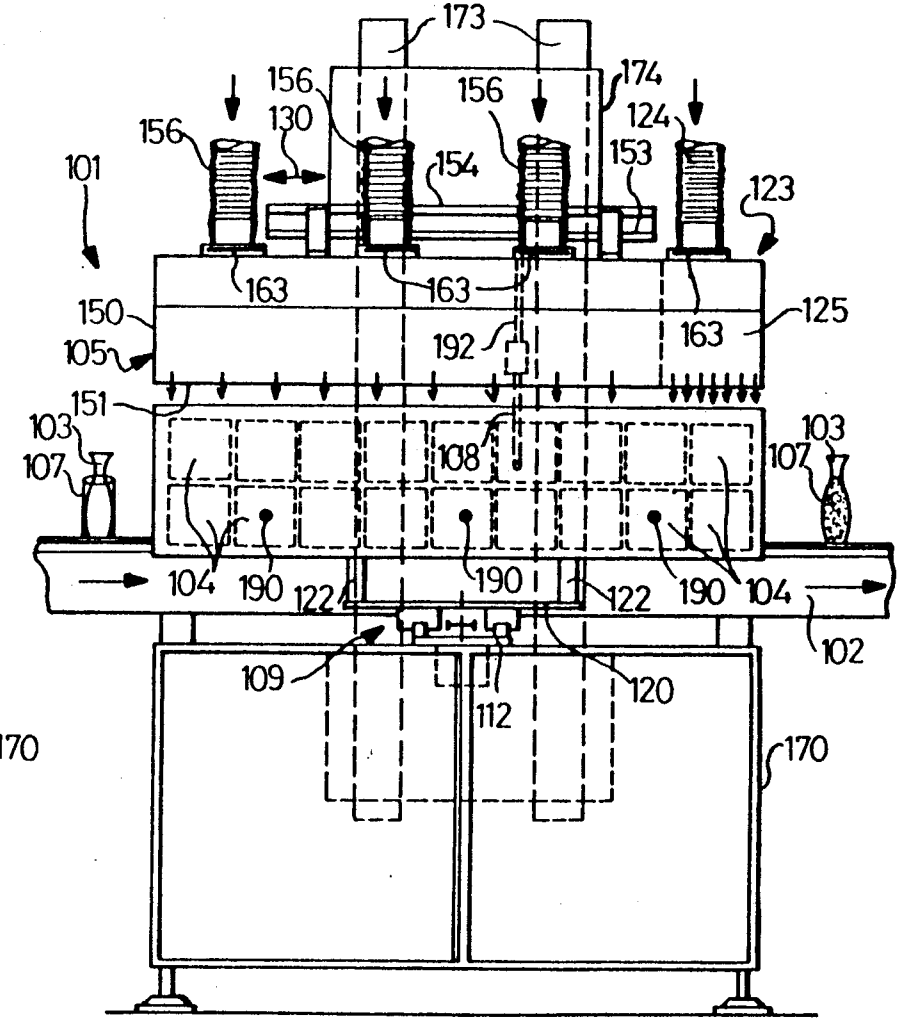
FIG. 2 is a longitudinal section through the FIG. 1 tunnel for distinguishing the heater elements disposed on the inside face of each side box of the tunnel more clearly.
Figure 1:
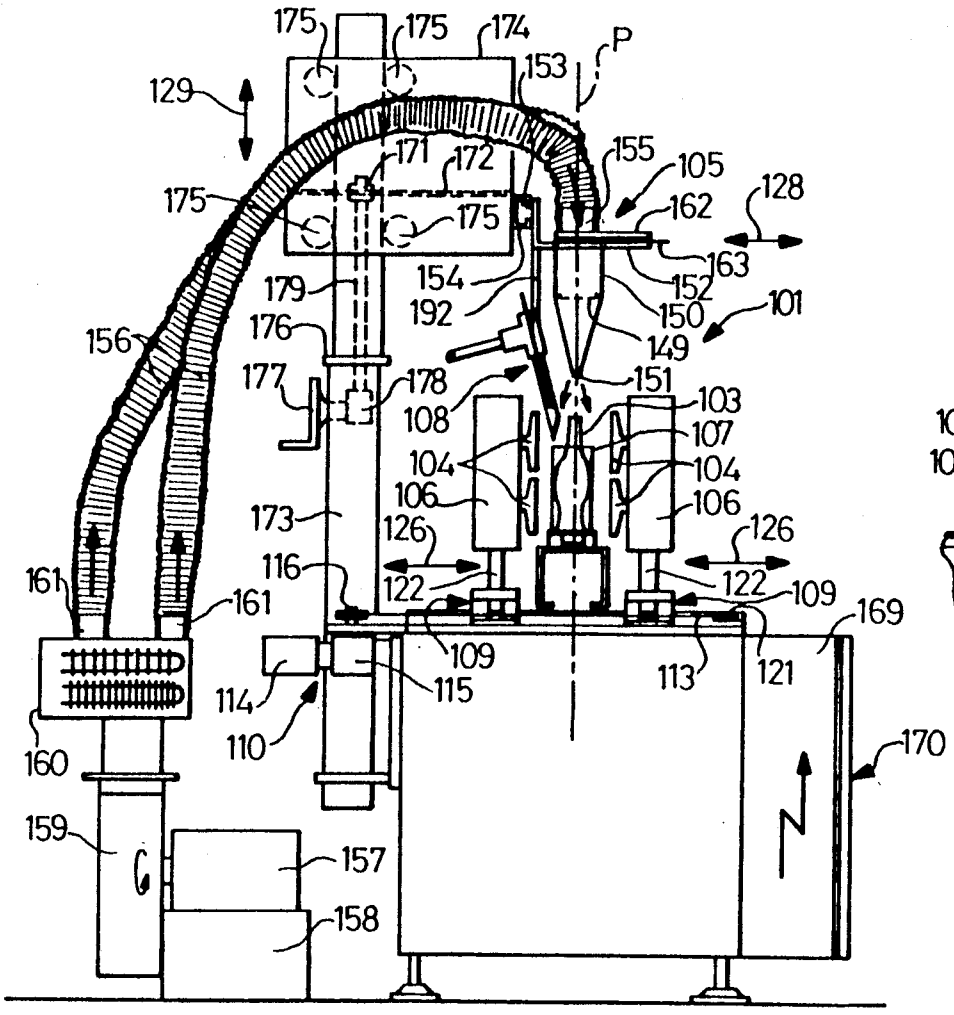
FIG. 1 is a side view of apparatus in accordance with the invention fitted to a tunnel through which objects are conveyed, with the apparatus also being provided, in this case, with heater means and with blower means in the top portion thereof, with the blower means being merely optional.

As can be seen in FIGS. 1 and 2, the temperature control apparatus of the invention is fitted in the present case to a tunnel 101 including conveyor means 102 for conveying objects 103, and heater means 104 disposed along its side walls 106.

If cooling is to be performed, then the means 104 should be replaced by any appropriate means for cooling the ambient temperature, e.g. means for blowing in cold air.

However, the control apparatus of the invention is described herein in the context of a particular application to shrinking a heat-shrink sleeve onto an object to be decorated or protected, in which application the sleeve is threaded loosely over the object and is then heated to a temperature higher than the softening temperature of the film from which it is made.

The tunnel 101 has two side walls 106 in the form of boxes whose height and length are a function of the object onto which the heat-shrink sleeve 107 is to be shrunk, and of the required throughput. Heater elements 104 are disposed on the inside faces of each box 106, said elements being infrared radiators, for example. The radiators are distributed along the height of the objects concerned, to constitute one or more series of superposed elements. In conventional manner, these elements are connected to a temperature regulation device (not shown) either individually or else in groups, with the device including a temperature probe 190 incorporated in each element or groups of elements concerned (with the temperature probes being visible in FIG. 2 only). This comprises conventional straight-forward regulation for the heater means of such tunnels. Naturally the infrared radiators could be replaced by any equivalent means, and could optionally be associated with flaps for distributing a flow of hot air.

The conveyor means 102 are shown herein as being in the form of an endless belt, but in a variant it would naturally be possible to use a chain provided with devices for grasping objects and driven continuously or stepwise, while holding the objects stationary relative thereto or while rotating the objects about their own axes. In this way, objects 103 to be coated travel on the endless conveyor 102 after respective sleeves 107 have been placed loosely over the objects by a conventional machine, with the sleeves being put into place prior to the objects entering the tunnel 101.

According to a fundamental aspect of the method of the invention, the temperature is sensed in a particular zone of the tunnel 101 in which a predetermined temperature is desired, and transverse displacement of the heater means 104 is organized in a direction essentially perpendicular to the direction in which the objects 103 are conveyed by means of a servo-control system ensuring that said heater means move automatically mutually towards each other or away from each other whenever the temperature as sensed differs from said predetermined temperature, thereby ensuring that the objects in question are permanently immersed in a constant temperature environment in this zone of the tunnel.

In order to implement such a method, and according to an essential aspect of the invention, the apparatus comprises: a temperature sensing member 108 disposed in a particular zone of the tunnel where a predetermined temperature is desired; at least one carriage 109 supporting the heater means 104, said carriage being transversely displaceable in a direction substantially perpendicular to the direction in which the objects 103 are conveyed; and motorized drive means 110 for automatically displacing the carriage 109 when the temperature sensed by the member 108 differs from said predetermined temperature in order to move said heater means towards each other or away from each other.

Thus, in accordance with this fundamental aspect of the invention, excellent temperature control can be obtained in a tunnel by servo-controlled transverse displacement of the heater means, and it should be understood that this servo-control could equally well be applied to cooling means in the context of a different application.

It is advantageous to ensure that the transverse displacement of the heater elements 104 takes place symmetrically about the midplane P of the tunnel 101 having the side walls 106 of the tunnel disposed on either side thereof. As a result the heater elements 104 are always moved towards each other or away from each other by the same amount, thereby preserving uniformity of temperature inside the tunnel. Because of this, in operation, it is observed that the heater elements 104 are in continuous transverse motion, oscillating through small corrective displacements.

The heater elements 104 are constituted in this case by infrared elements and they are normally supported on posts projecting from the side boxes 106. As a result it is easier to organize the transverse displacement of the heater elements 104 by displacing the two side boxes 106 having said elements disposed on their inside faces. The transverse displacement of the heater elements 104, or more particularly in this case of the side boxes 106 carrying said heater elements, is preferably organized in such a manner that the value of the displacement varies linearly as a function of the difference detected between the sensed temperature and the predetermined temperature.

As can be seen in FIG. 1, the temperature is preferably sensed by the temperature probe 108 fixed in the above-mentioned particular zone of the tunnel 101 close to where the objects 103 go past, and as far away as possible from the heater elements 104. Thus, as described below with reference to FIG. 4, it is advantageous to provide a temperature probe 108 which is protected from the direct action of the heater means.

As mentioned above, at least one moving carriage 109 is provided carrying a side box 106 whose inside face has the heater elements 104 disposed thereon in such a manner that the servo-controlled transverse displacement is applied to said side box of the tunnel 101. However, it is advantageous to provide two carriages 109 supporting the heater means 104 associated with each of the side walls of the tunnel 101 with the transverse displacement of said carriages being organized symmetrically about the midplane P of the tunnel on either side of which the side walls of the tunnel are disposed.

Figure 3:
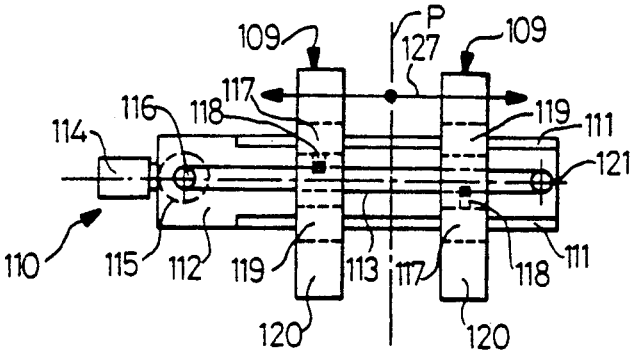
FIG. 3 is a fragmentary plan view showing a detail of the tunnel shown in FIGS. 1 and 2 and relating to the drive means associated with the servo-controlled sideways displacement of each of the boxes.

Such an embodiment is shown in FIGS. 1 and 2 and the drive means associated with the servo-controlled sideways displacement of each of the boxes are described in greater detail with reference to the fragmentary view of FIG. 3.

Each side box 106 is supported by a leg 122 whose bottom end is fixed to a support plate 120. Each of the support plates has associated riders 17 enabling it to slide on transverse rails 111 provided on an associated bar 112. It would also have been possible to use a single rail as the sliding support for both side boxes 106, however the embodiment shown including pairs of riders 119 and 117 provides excellent stability in the system even when the side boxes are long.

The two moving carriages 109 thus move on associated transverse rails 111 which are provided, in this case, at the bottom of the tunnel extending beneath the means 102 for conveying objects. The moving carriages 109 are also connected to motorized drive means 110 by a common coupling means 113. In the example shown, the common coupling means 113 is made in the form of a continuous transverse chain with each length thereof engaging one of the moving carriages 109. More precisely, one of the two riders associated with each moving carriage (and in particular the rider 117) is connected by means of a tab 118 to the continuous transverse chain 113, whereas the other rider 119 serves merely as a sliding support. This ensures that both moving carriages 109, and thus both side boxes 106 that they carry, move transversely through the same distance relative to the midplane P, as shown diagrammatically by double-headed arrow 127.

The motorized drive means 110 are constituted in this case by a motor and stepdown gear box unit 114, 115. This unit comprises an electric motor 114 which is controlled by the temperature probe 108 via an associated temperature regulator (not shown), together with a stepdown gear box 115 whose outlet is provided with a toothed wheel 116 meshing with the continuous transverse chain 113. One end of the continuous transverse chain 113 thus passes round the wheel 116 while its other end passes round a wheel 121 which is preferably associated with a chain-tensioning member.

It is advantageous to ensure that the connections between the motor and gear box unit 114, 115 both with the driving toothed wheel 116 and with the temperature regulator of the temperature probe 108 are such that the displacement of each of the carriages 109 and thus of the side boxes 106 supported thereby varies linearly as a function of the temperature difference detected by the temperature probe, e.g. through one millimeters per degrees Celsius.

To this end, it is advantageous for the gear box of the motor and gear box unit to have a very large stepdown ratio so as to be able to move the boxes very slowly under perfect control. In particular, a stepdown ratio of 1 to 5,000 and suitable for obtaining linear displacements of about 2 cm per minute can give excellent results in such an application. Naturally the motor and gear box unit could be replaced by any other equivalent mechanical means such as a screw having two oppositely-handed threads extending along an axis perpendicular to the axis of the outlet shaft from the above-described gear box. Such a variant would have the advantage of the screw with oppositely-handed threads itself providing a stepdown ratio, but such screws are difficult to make.

If the infrared type heater elements 104 are replaced by nozzles for blowing air, the principle of transverse displacement would remain exactly the same by organizing the displacement of the side boxes within said nozzles (such side boxes would be comparable in volume to those used for supporting the heater elements 104 in this case).

Figure 4:
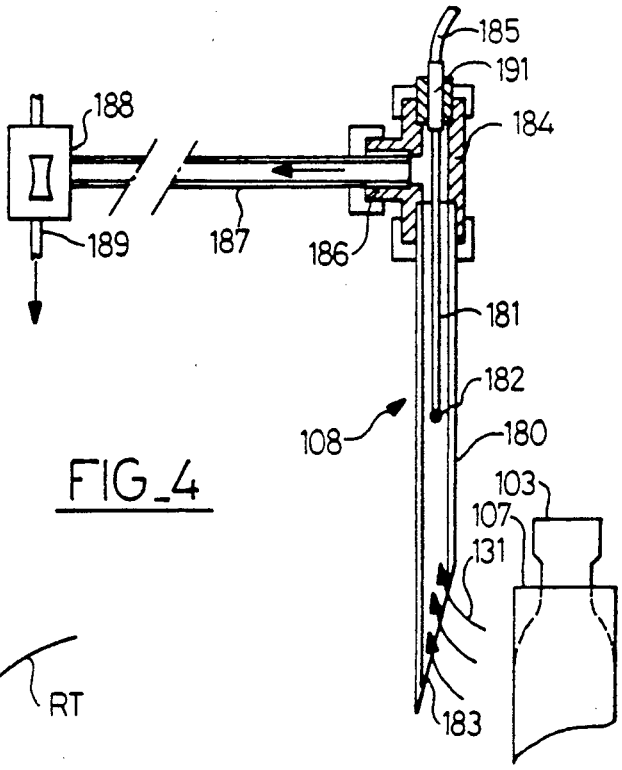
FIG. 4 is a cross-section showing another detail of the temperature probe used for sensing temperature, said temperature probe being protected against the direct effect of the heater elements and being connected to a suction venturi.
Figure 5:
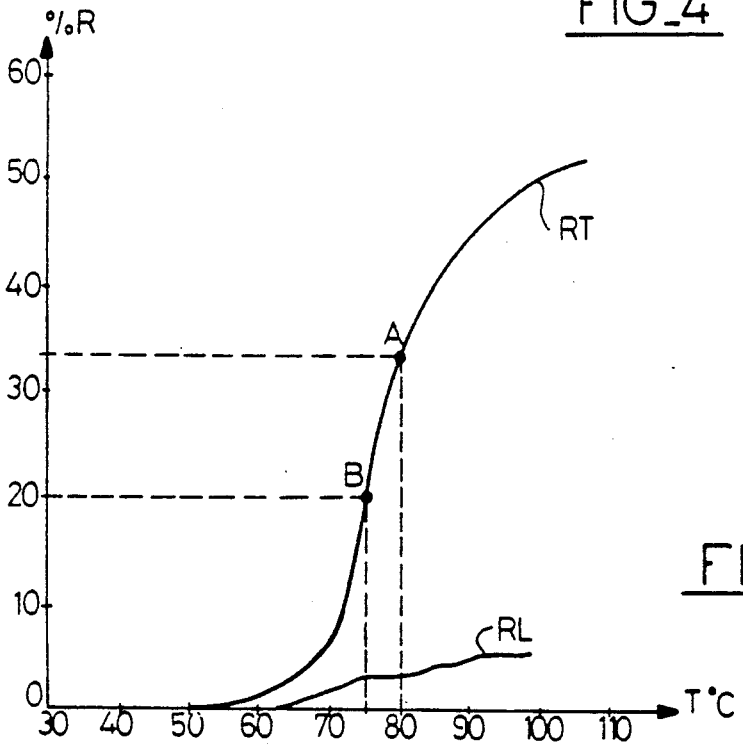
FIG. 5 is a graph recalling two typical curves RT and RL representative of changes in shrinkage percentage (%R) as a function of temperature (in °C.); this graph is already described above and shows the importance of obtaining a temperature which is simultaneously accurate, constant, and uniform in order to ensure that shrinkage takes place under optimum conditions (and the graph of FIG. 5 is therefore not described in greater detail in the description below).

The structure of the temperature sensor 108 is now described in greater detail with reference to FIG. 4.

As mentioned above, temperature is sensed by means of a temperature sensor or probe 108 which is fixed and which is protected against direct action from the heater elements 104. It is advantageous for the fixed temperature sensor 108 which is connected to a temperature regulator to be protected against the direct action of the heater elements 104, preferably by being received in an open protective tube such as the tube 180, in which suction is set up. The temperature sensor 108 thus comprises a body 191 which is extended downwards by a capillary tube 181 whose bottom end 182 constitutes the temperature sensing point. The body 191 is fixed in a T-connector 184 which supports the protective tube 180 and which also serves to provide a connection via its side branch 186 to a hose 187 leading to a suction venturi 188. The suction venturi 188 forms a part of a circuit 189 of conventional design for setting up suction in a circuit by means of a connection to the throat of the venturi. The protective tube 180 is preferably made of quartz in order to withstand the action of the heater elements 104 adequately, and it should be observed that its open bottom end 183 is chamfered and faces towards the objects being conveyed 103. The chamfer at the bottom open end of the tube 108 thus serves both to provide excellent protection of the sensor against direct action from the heater element 104, and to admit a flow of air (arrows 131) corresponding with excellent accuracy to the air which was in the vicinity of the object, i.e. very particularly the air whose temperature is to be measured. By virtue of this protection of the sensor against thermal disturbances it is possible to obtain extremely accurate measurements, thereby naturally giving rise to very fine servo-control of the transverse displacement of the heater elements. The measurement connection to the temperature sensor 108 is represented diagrammatically by an outlet flex 185 from the body 191 of the temperature sensor.

It is thus easy to cause the heater elements 104 to be displaced in such a manner that their displacement varies linearly as a function of the difference detected between the temperature sensed by the temperature sensor 108 and the predetermined temperature which is desired in a particular zone of the tunnel corresponding to the shrinkage zone. The predetermined temperature itself varies as a function of the temperature in the workshop where the shrinkage operations are being performed, and as a result it is advantageous to organize the servo-control in such a manner that the sum of the workshop temperature plus said predetermined temperature is maintained substantially permanently constant.

Returning to FIG. 1, it can be seen that the temperature sensor 108 is carried by a support 192 connected, in this case, to the support for the means for blowing in a gaseous fluid. The temperature sensor 108 is naturally mounted on its support 192 by means providing numerous position-adjustment options so that the chamfered opening 183 of the protective tube 180 can be placed in the best possible position.

The servo-controlled transverse displacement of the heater elements 104 constitutes an essential characteristic of the method and of the apparatus of the invention, with said transverse displacement being shown diagrammatically by arrows 126 in FIG. 1. It is essentially by virtue of this servo-controlled transverse displacement of the heater elements 104 that a constant temperature environment is achieved in the particular zone of the tunnel 101 into which the object 103 inside its sleeve 107 is conveyed, thereby making it possible to obtain uniform shrinkage of the sleeve onto the object.

However, it is advantageous to provide for the objects 103 to be subjected as they pass along the tunnel 101 to a flow of gaseous fluid in a direction which is essentially perpendicular to the direction in which the objects are conveyed, said flow serving initially to inflate each sleeve 107 when the corresponding object 103 penetrates into the particular zone of the tunnel 101. The flow of gaseous fluid should be at the said predetermined temperature of said particular zone. The gaseous fluid is preferably blown in by directing the flow down from above the objects 103 while they are being conveyed essentially horizontally, with the flow direction being generally substantially vertical.

As shown in FIGS. 1 and 2, the apparatus of the invention also includes means 105 for blowing a gaseous fluid towards the objects 103 being conveyed, as mentioned above. The blower means 105 essentially comprise a wind box 150 having an elongate bottom slot 151 for producing a continuous sheet of air, with said wind box being disposed above the tunnel 101 so that the flow is directed generally vertically down onto the objects 103. In FIG. 1, it can be seen that the wind box has an internal grid 149 disposed essentially horizontally and performing two functions: the grid serves to make the gas flow uniform and it also serves to slow down the high speed of the fluid when a blower fan is used, as in the present case.

The wind box 150 has top connector fittings 155 to which associated ducts 156 are engaged. Naturally, the blower means shown in these figures are merely an example, but they include a motor 157 mounted on a stand 158 and driving a fan 159 whose outlet feeds a heater box 160 including heater elements, and having outlet fittings 161 connected to the opposite ends of said duct 156. Means are naturally provided for adjusting the heater means in the box 160 so that the temperature of the blown-in air does indeed correspond to the desired predetermined temperature.

In addition to adjusting temperature, it is advantageous to be able to adjust the outlet flow along each of the ducts 156. This may be done, for example, by means of slide valves 162 associated with each of the connector fittings 155, with each of the slide valves 162 including a slide 163 in the form of a moving plate which is pulled to a greater or lesser extent like a conventional diaphragm. It is thus possible to control the rate at which air is blown through successive longitudinal zones, and this adjustment may be advantageous in certain applications (with position adjustment of the slides 163 being represented diagrammatically by arrow 128 in FIG. 1).

The wind box 150 is preferably supported by a bracket 173, 174 so that its height and/or longitudinal position can be adjusted.

In the present case, the wind box 150 is fixed on a support 152 having a longitudinal link rod 153 which slides in a channel section slideway 154 fixed to a support head 174 forming a portion of the bracket. The support 152 may also support the temperature sensor 108, as shown in FIG. 1. This form of mount enables the wind box 150 to be displaced longitudinally, as represented in FIG. 2 by arrow 130. As mentioned above, it is advantageous to be able to adjust the height of the wind box 150 so as to adjust its position in an essentially vertical direction, thereby making it possible to completely surround objects inside their sleeves as they pass along the tunnel. The views of FIGS. 1 and 2 show a simple way of obtaining such height adjustment. The wind box 150 is supported in this case by a bracket in above-mentioned head 174 which is slidably mounted on two vertical posts 173 via guide wheels 175. Any conventional means may be used for position adjustments, e.g. the screw system shown in the figures. This system comprises a control wheel 177 and an angle connection 178 mounted on a horizontal plate 176 and driving an endless screw 179 engaging a nut 171 carried by a top plate 172 which is fixed to the support head 174.

The wind box 150 can thus be accurately positioned above objects passing along the tunnel so as to blow a gaseous fluid down onto the objects at the desired predetermined temperature.

It may be observed that although the wind box 150 is shown as being connected to the common fan 159 by associated connecting ducts 156, it would naturally be possible to provide a plurality of independent fans associated with independent air feed circuits. In a variant, it would also be possible to dispose the fan 159 and the associated resistance box 160 on the support head 174, and this would provide several advantages. In such a configuration, the fan would be completely protected in a closed enclosure, thereby enabling the air to be filtered and protecting the fan from such dust as may be found at ground level. In addition, the connecting ducts 156 could be much shorter.

Although not essential, the blower means described above nevertheless make it possible in the particular application of shrinking a heat-shrink sleeve onto an object to obtain extremely advantageous ballooning of the sleeve prior to its shrinking onto the object. This ballooning effect is most advantageous because it solves a difficulty well known to the person skilled in the art. It is not possible to obtain uniform shrinking both in surfaces which are not in contact with the object and in surfaces which are in contact therewith. Such contact has the effect of changing the temperature at the periphery of the film in the zones concerned, thereby giving rise to different shrinkage percentages even though it is desirable for the shrinkage to be uniform (some portions of the film stop shrinking as soon as they make contact with the object, whereas other zones or folds due to the sleeve being initially presented in the form of a flat length of sheath shrink more than initially intended).

FIG. 2 also shows an additional blower member 123 mounted downstream from the wind box 150 and made, for example, in the form of an extractor fan, and serving optionally to provide final heating of the objects 103. The purpose of such an additional blower member is to raise the temperature of an object onto which a sleeve has been shrunk for a short period of time to a high temperature which is considerably greater than the above-mentioned predetermined temperature in the shrinking zone, with the high temperature performing a finishing or smoothing operation. The blower member 123 is in the form of a downstream compartment 125 of the wind box 150 which is fed by its own feed duct 124. However, it would naturally be possible to provide a separate box with separate feed means and separate electrical heater means. The temperature of the air blown out from the additional blower means 123 is preferably controlled by means of a temperature sensor disposed inside its outlet nozzle (not shown).

The inlet and outlet zones of the tunnel 104 can thus be organized to operate under optimum conditions. In particular, prior to reaching the zone of the tunnel into which the gaseous fluid is blown, the object 103 inside its sleeve 104 could be subjected to preheating solely by the action of the heater elements 104 of the tunnel, so as to reach a temperature very close to the shrinking point of the sleeve. In addition, downstream from the zone of the tunnel into which the gaseous fluid is blown, the object onto which the sleeve 107 has been shrunk can be subjected to additional heating by the additional blower means 123 mentioned above, thereby raising it for a short period of time to a high temperature which is considerably greater than the predetermined temperature of the gaseous fluid, thus performing a finishing or smoothing operation.

The method of the invention, and the associated apparatus for implementing it, thus enable a heat-shrink sleeve to be shrunk quite uniformly by constant and accurate control of the temperature in the tunnel.

By controlling the temperature field, no air is blown in at too high a temperature (assuming that air is blown in at all), which would have the consequence of causing the shrinking to be non-uniform by virtue of temperature differences between the inside and outside faces of the heat-shrink sleeve, and also of causing the top of the sleeve to shrink before the bottom, thereby shutting off the air-flow path and impeding shrinking of the bottom portion of the sleeve. The temperature control also avoids blowing in air which is too cold, which would also give rise to non-uniform shrinking of the sleeve and would cause the bottom portion of the sleeve to close by virtue of premature shrinking at the bottom.

The invention thus provides a particularly simple and effective solution to the temperature control problem which needs to be mastered when performing heat-shrinking operations, and it makes it possible to obtain a temperature which is simultaneously accurate, constant, and uniform in a critical zone of a tunnel where heat-shrink sleeves are shrunk. Such control provides maximum possible isolation from inevitable external disturbances.

The invention is not limited to the embodiment described above but on the contrary extends to any variant which uses equivalent means to reproduce the essential characteristics of the claims.

I claim:

1. A method of controlling the temperature in a tunnel which is open at both ends, wich includes first and second heating means disposed respectively along opposed side walls of said tunnel between which at least one conveyed object passes and along which said conveyed object is displaced in a first horizontal direction by a conveyor means in order that a heat-shrinkable sleeve placed loosely about said conveyed object can be shrunk onto said conveyed object, said method comprising:

selecting a predetermined temperature at which said heat-shrinkable sleeve will shrink uniformly when said conveyed object is subjected to said predetermined temperature;

sensing a temperature in a first particular longitudinal zone of said tunnel between said ends thereof in which said predetermined temperature is desired; and controlling transverse displacement of said first and second heating means in a second horizontal direction essentially perpendicular to said first horizontal direction, thereby displacing said first and second heating means relative to each other whenever said sensed temperature differs from said predetermined temperature, thereby maintaining a constant temperature environment for said conveyed object as said conveyed object is displaced through said first particular zone of said tunnel.

2. The method according to claim 1, wherein the transverse displacement of said first and second heating means is accomplished by moving said first and second heating means symmetrically about a vertical midplane of said tunnel between said opposed side walls of said tunnel.

3. The method according to claim 1, wherein the transverse displacement of said first and second heating means is accomplished by moving a first side box having said first heating means disposed on its inside face and a second side box having said second heating means disposed on its inside face.

4. The method according to claim 1, wherein the transverse displacement of said first and second heating means is accomplished in such a manner that the transverse displacement varies linearly as a function of the difference between said sensed temperature and said predetermined temperature.

5. The method according to claim 1, wherein said controlling of the transverse displacement of said first and second heating means in a second horizontal direction is accomplished by a servo control system.

6. The method according to claim 1, wherein said sensed temperature is sensed in said first particular zone of said tunnel as near as possible to said conveyed object as said conveyed object passes through said first particular zone and as far away as possible from said first and second heating means.

7. The method according to claim 6, wherein said sensed temperature is sensed by means of a fixed temperature sensor which is disposed in an open protective tube in which a suction is established.

8. The method according to claim 1, wherein as said conveyed object is conveyed through a second particular zone of said tunnel said conveyed object is also subjected to a flow of a gaseous fluid that is at said predetermined temperature and that is blown in a direction substantially perpendicular to said first horizontal direction, said flow of gaseous fluid serving to inflate said sleeve prior to said conveyed object entering said first particular zone of said tunnel.

9. The method according to claim 8, wherein the gaseous fluid is blown in by directing the flow of gaseous fluid down onto said conveyed object in a direction which is substantially vertical.

10. The method according to claim 8, wherein prior to said conveyed object entering said second particular zone of said tunnel in which said gaseous fluid is blown, the conveyed object inside said sleeve is subjected to preheating solely by the action of said first and second means in said second particular zone of said tunnel such that said conveyed object reaches a temperature near which said sleeve begins to shrink.

11. The method according to claim 8, wherein the method further includes a finishing operation that occurs downstream from said first particular zone of said tunnel during which said conveyed object onto which said sleeve has been shrunk is subjected to heating by the action of said first and second heating means and also by the action of an additional blower means in order that said conveyed object with said sleeve thereon is raised for a very short period of time to a temperature that is considerably greater than the predetermined temperature.

* * * * *